United States Patent [19]

Takano

[11] Patent Number: 4,634,824

[45] Date of Patent: Jan. 6, 1987

[54] MINIATURIZED ELECTRIC CONTACT ASSEMBLY FOR MICROSWITCH

[76] Inventor: Tetsuo Takano, 446 Tachihongo, Yatsuomachi, Nei-gun, Toyama-ken, Japan

[21] Appl. No.: 707,404

[22] Filed: Mar. 1, 1985

Related U.S. Application Data

[63] Continuation-in-part of Ser. No. 430,357, Sep. 30, 1982, abandoned.

[30] Foreign Application Priority Data

| | | | |
|---|---|---|---|
| Oct. 13, 1981 | [JP] | Japan | 56-161974 |
| Dec. 28, 1981 | [JP] | Japan | 56-209726 |
| Jul. 26, 1982 | [JP] | Japan | 57-129009 |

[51] Int. Cl.[4] ..... H01H 1/02

[52] U.S. Cl. ..... 200/266; 420/496

[58] Field of Search ..... 200/262, 266, 267; 420/496

[56] References Cited

U.S. PATENT DOCUMENTS

| | | | |
|---|---|---|---|
| 2,147,844 | 2/1939 | Kelly | 420/496 |
| 2,809,929 | 10/1957 | Ostrow et al. | 420/496 X |

FOREIGN PATENT DOCUMENTS

| | | | |
|---|---|---|---|
| 6498 | 1/1980 | Japan | 420/496 |
| 154540 | 12/1980 | Japan | 420/496 |
| 6105645 | 8/1981 | Japan | 420/496 |

*Primary Examiner*—Stephen Marcus
*Assistant Examiner*—Renee S. Luebke
*Attorney, Agent, or Firm*—Oblon, Fisher, Spivak, McClelland & Maier

[57] ABSTRACT

A contact assembly for a microswitch has a contact material inserted into and calked in a hole formed in a base material which is a copper alloy having iron phosphide crystallized therein and having a chemical composition of 0.025 to 0.040% by weight of phosphorus, 0.05 to 0.15% by weight of iron and the rest of copper.

4 Claims, 7 Drawing Figures

MINIATURIZED ELECTRIC CONTACT ASSEMBLY FOR MICROSWITCH

REFERENCE TO COPENDING APPLICATION

This is a continuation-in-part application of my copending application Ser. No. 430,357 filed Sept. 30, 1982, now abandoned.

BACKGROUND OF THE INVENTION

1. Field of the Invention

This invention relates to a miniaturized electric contact assembly for a microswitch including a mating contact wherein the term "contact assembly" used throughout the specification means an assembly having a contact joined with a base material and wherein the contact as joined with the base material is brought into contact with the mating contact.

2. Description of the Prior Art

Conventional contact assemblies are produced by or by molding a contact material into a rivet shape and calking the rivet-shaped contact material into a hole in a base material. The former contact assemblies pose problems in that the area of connection between the contact material and the base material, i.e. the section area of the welded portion, is small and in that a defective weld sometimes occurs. The latter contact assemblies pose a problem in terms of efficiency because the contact materials molded into a rivet shape are inserted into the calked on the base material one by one.

The inventor has previously proposed a method for the manufacture of contact assemblies by pressing, which is disclosed in Japanese Patent Publication No. SHO 55(1980)-24365. This method uses a continuous die press capable of simultaneously carrying out a number of processes and comprises punching a hole in a web sheet of base material, raising the base material surrounding the hole, laterally cutting a slice from a round rod of contact material being vertically fed down to a position obliquely upward of the hole, vertically inserting the slice of contact material into the hole and calking the contact material into the hole, whereafter the base material is cut to produce a miniaturized contact assembly suitable for use in a microswitch. The inventor has also proposed a method for the mass production of contact assemblies having rectangular contacts, which comprises horizontally feeding a rectangular material for contacts to a continuous die press, shearing the end thereof by punching and, at the same time, successively inserting the sheared materials into the punched rectangular holes, calking the inserted materials and cutting off the individual contact assemblies (U.S. Pat. No. 4,259,557).

The contact assemblies made by calking with a press overcome the problems encountered in the aforementioned contact assemblies made by projection welding and by calking of a rivet-shaped contact material, and have earned a good reputation as high-performance contact assemblies having excellent conductivity and a heat transfer property between the contact and the base material.

In manufacturing the aforementioned contact assemblies by projection welding or by calking of a rivet-shaped contact material, it has heretofore been impossible from the point of manufacture to make the contacts very small. Although it is possible to make the contacts smaller in accordance with the methods disclosed in the aforementioned Japanese Publication and U.S. Patent, contacts of such a small size increase in temperature due to their electric resistance and the instantaneous electric arc resulting from repeated use thereof relative to mating contacts. Since they have small thermal capacity and their surface areas through which heat is diffused onto the base material or in the atmosphere are also small, the temperature thereof becomes larger and larger, with the result that there arises a possibility of the smaller contacts being fused. For these reasons, it has been known that contacts have to have a size large enough so that the surface area thereof can be more than ten times the predetermined actual contact area.

On the other hand, owing to the development of miniaturized and simplified control devices, small switches of high capacity which allow a main current to flow without use of a relay have come into demand. To meet this demand, ultra-miniaturized switches of the size of beams, which exhibit a high capacity on the order of AC 125 V, 7 A, for example, have recently been developed and are now commercially available on the market. In ordinary switches, the contact is made of silver and the base material is generally made of brass, from the standpoints of conductivity, strength and manufacturing cost. However, in the aforementioned small switches of high capacity, both the contact and the base material are made of silver and, therefore, the switches are very expensive as compared with conventional switches and have come to be utilized in space devices and for military and other special purposes.

OBJECT AND SUMMARY OF THE INVENTION

The object of this invention is to provide a inexpensive miniaturized electric contact assembly for a microswitch, which has a function substantially. equivalent to that of a contact assembly having a contact and a base material made both of silver and being usable in a microswitch of high capacity.

To attain the object described above according to the present invention, there is provided a miniaturized electric contact assembly for a microswitch obtained by inserting and calking a contact material into a punched hole in a base material and comprised of the contact which is formed of a conventional contact material such as silver, silver alloy or gold and the base material formed of an oxygen free copper alloy having iron phosphide crystallized therein and having a chemical composition of 0.025–0.040% of phosphorus, 0.05–0.15% of iron and the rest of copper.

Since the aforementioned oxygen free copper alloy as the base material exhibits a heat transfer property equal to or higher than that of silver, even when a contact assembly formed by joining contact material to the base material of copper alloy substantially in an integral state is used in a high-capacity microswitch, heat generated by repeated use of the contact relative to a mating contact is rapidly transmitted and radiated to the base material. Therefore, the amount of expensive contact material used can be reduced and the contact assembly can be made small so as to be advantageous from an economical point of view. Even a small contact assembly can stand up under a large current.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

The construction of prior art contact assemblies will be briefly described before the description of the present invention.

Figure 1:
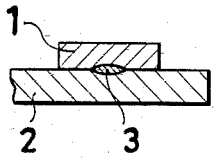
FIG. 1 (PRIOR ART)
FIG. 1 is a cross-sectional view showing a conventional contact assembly obtained by injection welding.

FIG. 1 shows a prior art contact assembly in which a projection is pre-formed on the lower surface of a contact material 1, and the projection is pressed down onto a base material 2 and at the same time, electric power is supplied thereto to form a projection welded portion 3. In this case, the welded portion has a small sectional area and it is difficult to detect articles having poorly welded portions.

Figure 2:
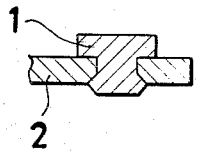
FIG. 2 (PRIOR ART)
FIG. 2 is a cross-sectional view showing another prior art contact assembly obtained by inserting and calking a rivet-shaped contact material in a hole in a base material.

FIG. 2 shows another prior art contact assembly in which a rivet-shaped contact material 1 is fitted and calked in a hole in a base material 2. In this case, cumbersome work is involved in forming contact materials into a rivet shape one by one and fitting the same into holes in the base material before calking.

Figure 3:
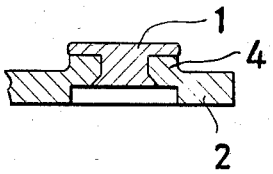
FIG. 3 (PRIOR ART)
FIG. 3 is a cross-sectional view showing still another prior art contact assembly obtained by calking.

FIG. 3 shows still another prior art contact assembly previously developed by the inventor, in which a contact material 1 is firmly pressed into a hole in the swollen portion 4 of a base materal 2. Accordingly, the connection area between the contact material and the base material is large. Since the contact material is calked on the base material immediately after being cut, there is no fear of an oxide being interposed between the contact material and the base material, and the electrical and heat conductivities of the connection portion therebetween are substantially equal to those of the connection portion by metallurgical bonding. It can be therefore considered that the contact material and the base material are integral in terms of heat transfer.

Figure 4:
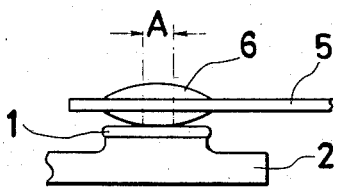
FIG. 4 is an explanatory view showing the state of contact between a contact and a mating contact.

The contact assembly having the calked contact can overcome the disadvantages encountered by the conventional contact assemblies having a welded contact and having a rivet-shaped contact and is suitable for mass production. The state of contact between the calked contact 1 and a mating contact 6 is as shown in FIG. 4, in which the mating contact 6 of silver etc. is retained by a base member 5 of a material abounding in elasticity, such as phosphor bronze or beryllium copper, to form a movable mating contact assembly and is brought into contact with and released from the contact 1 by a switch operation. The surface area of the contact 1 has been required to be at least ten times the actual contact area, which is a circle with a diameter of "A", although the actual contact area varies slightly between a new contact and one worn by use.

Figure 5:
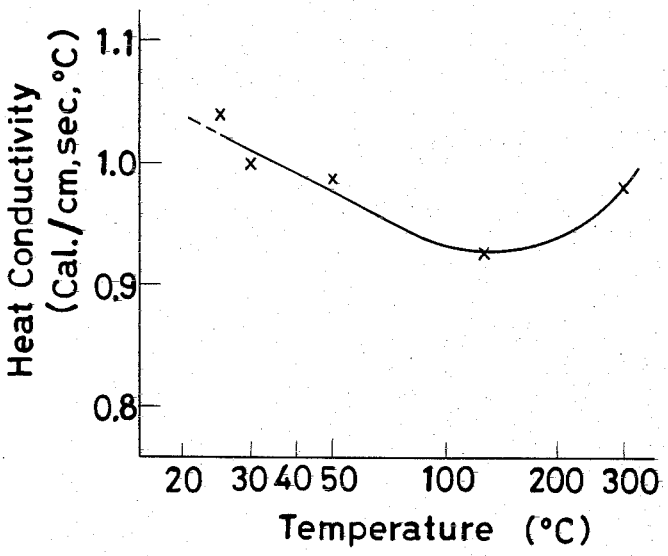
FIG. 5 is a graph showing the relation between the heat transfer rate and the temperature of a copper alloy used as the base material of a contact assembly according to the present invention.

Since the heat transfer rate between the calked contact and the base material of the contact assembly is substantially equal to that between the contact and the base material which are integrally formed, as described above, if the contact assembly is formed of a base material excellent in heat transfer rate and a small calked contact, heat generated on the contact is rapidly transferred to the base material. In the present invention, an oxygen free copper alloy having iron phosphide crystallized therein and having a chemical composition of 0.025 to 0.040% by weight of phosphorus, 0.05 to 0.15% by weight of iron and the rest of copper is used as the base material. The heat conductivity of this copper alloy is 1.04 cal/cm,sec. at 20° C. as shown in the graph of FIG. 5 and is superior to that of silver (1.00 cal/cm,sec. at 20° C.). The copper alloy has an electrical conductivity of 92% IACS at 20° C., a melting point of more than 1000° C. and a tensile strength of more than 40 kg/mm$^2$. If the respective amount of the phosphorus and iron in the copper alloy fall outside the aforementioned ranges, they coexist in the copper alloy without being uniformly crystallized in the form of iron phosphide and, therefore, the mechanical strength of the copper alloy is degraded.

A method for the manufacture of the aforementioned copper alloy will be briefly described. Copper as the matrix is treated into oxygen free copper in a complete form. Since oxygen free copper includes a trace quantity of deoxidized phosphorus, a prescribed amount of iron is added thereto. The mixture is subjected to solution treatment by cooling and subsequently to precipitation hardening by annealing, thereby causing minute particles of iron phosphide to be crystallized in the matrix. Since the copper alloy thus manufactured does not include any expense element, the cost thereof is as low as that of brass. The present invention is the fruit of the inventor's studies based on the idea that the heat conductivity is more important than the electrical conductivity to the base material.

Figure 6:
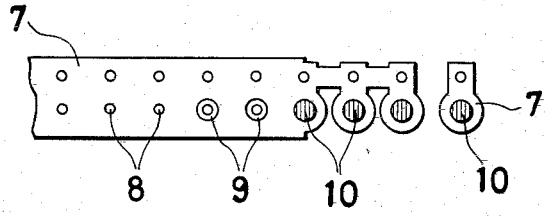
FIG. 6 is a plan view showing the processes for manufacturing a contact assembly according to the present invention.
Figure 7:
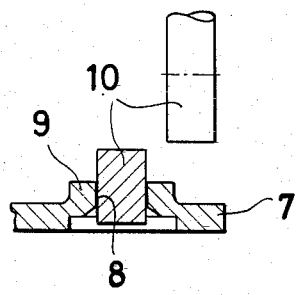
FIG. 7 is an explanatory view showing the state in which a contact material has been inserted into a hole in the base material and is ready for calking.

An example of a method for the manufacture of a contact assembly having the aforementioned copper alloy as the base material will be described with reference to FIG. 6 and FIG. 7. A strip of base material 7 made of the aforementioned copper alloy is horizontally conveyed to a press to form therein holes 8 of a given shape and, as occasion demands, the portions of the base material around the holes are thrust from below by a die to form projections 9. A contact material 10 cut to a given length is inserted into the hole 8 and pressed longitudinally from both ends thereof to be joined to the base material 7 so that one end of the contact material is attached to the projection 9. As occasion demands, striation grooves may be formed in the surface of the contact. The strip of base material is then cut to obtain a contact assembly as shown in FIG. 6. Silver, silver alloy or silver cladding material may be used as the contact material 10.

Since the rear surface of the contact brought into contact with the mating contact 16 is firmly joined to the base material 7 and since the base material is formed of a material having high heat conductivity, the surface of the contact may have a minimal area which is the actual area of contact with the mating contact determined by the magnitude of a current used plus allowance for error in assemblage, i.e. two to four times the actual contact area. The heating value after the contact assembly has been used for a long time through continuous or intermittent application of a current is equal to or smaller than that of a contact assembly made of silver. Thus, the present invention can provide at a low cost a contact assembly for use in a high-capacity microswitch, with the amount of expensive contact material being reduced to a minimum. Further, since the contact assembly of the present invention can be manufactured merely by inserting and calking a cut contact material in a hole bored in a base material, it is suitable for miniaturization and mass production.

An example of this invention will now be described. A strip of base material, 25 mm in length, 5 mm in width and 0.5 mm in thickness and made of a copper alloy having a chemical composition of 0.10% by weight of iron, 0.034% by weight of phosphorus and the rest of copper, was punched at one end thereof to form a 1 mm square hole. A silver rod was inserted into the hole as a contact and calked therein to form a contact assembly. The contact of the formed contact assembly measured about 2 mm×2 mm. A silver plate was latched on one surface thereof so that the actual area of contact between the contacts might be 2 $mm^2$. An electric current of 100 V, 10 A was applied between the contact assembly and the mating contact and intermittent contact between the contacts was effected 100, 500 and 1000 times. The electrical conductivities and the temperatures of the contact were measured upon elapse of the respective times mentioned above. The results are as shown in Table below. For comparison, contact assemblies of the same size having a copper base material and a silver base material were measured under the same conditions. The results are also shown in Table below.

| Intermittent Contact | | Cu alloy | Cu | Ag |
|---|---|---|---|---|
| 100 times | Conductivity (% IACS) | 97 | 95 | 98 |
| | Temperature (°C.) | 38 | 43 | 42 |
| 500 times | Conductivity (% IACS) | 96 | 94 | 97 |
| | Temperature (°C.) | 46 | 52 | 49 |
| 1000 times | Conductivity (% IACS) | 96 | 94 | 97 |
| | Temperature (°C.) | 51 | 57 | 54 |

It will be noted from the table that the copper alloy can be sufficiently used as the base material of a contact assembly for use in a microswitch.

Obviously, numerous modifications and variations of the present invention are possible in light of the above teachings. It is therefore to be understood that within the scope of the appended claims, the invention may be practiced otherwise than as specifically described herein.

What is claimed as here and desired to be secured by Letters Patent of the United States is:

1. A contact assembly for a microswitch, comprising:
a base material having a hole formed therein; and
a contact material inserted into and calked in the hole in the shape of a rivet, wherein said base material comprises a copper alloy having iron phosphide crystallized therein, having an electrical conductivity of 96–97 (% IACS), having a heat transfer rate of not less than 1.0 (cal/cm, sec, °C.) at a temperature of approximately 20° C. and having a chemical composition of 0.025 to 0.040% by weight of phosphorus, 0.05 to 0.15% by weight of iron and the remainder copper.

2. The improvement according to claim 1, wherein said contact material is silver.

3. The improvement according to claim 1, wherein said contact material is a silver alloy.

4. The improvement according to claim 1, wherein said contact material has a surface area two to four times an actual area of contact between said contact material and a mating contact determined by a magnitude of current applied therebetween.

* * * * *